United States Patent [19]

Utsumi et al.

[11] Patent Number: 4,913,331

[45] Date of Patent: Apr. 3, 1990

[54] INTERNAL-COMBUSTION PISTON DRIVING APPARATUS HAVING A DECOMPRESSION CHANNEL

[75] Inventors: Hiromu Utsumi, Katsuta; Yo Kawakami, Mito; Shinki Ohtsu, Ibaraki, all of Japan

[73] Assignee: Hitachi Koki Company, Ltd., Tokyo, Japan

[21] Appl. No.: 261,074

[22] Filed: Oct. 21, 1988

[51] Int. Cl.[4] ..... B25C 1/04; B25C 1/08

[52] U.S. Cl. ..... 227/10

[58] Field of Search ..... 227/8, 9, 10, 11

[56] References Cited

U.S. PATENT DOCUMENTS

| | | | |
|---|---|---|---|
| 4,403,722 | 9/1983 | Nikolich | 227/8 |
| 4,483,473 | 11/1984 | Wagdy | 227/10 X |
| 4,717,060 | 1/1988 | Cotta | 227/10 |
| 4,721,240 | 1/1988 | Cotta | 227/9 X |
| 4,773,581 | 9/1988 | Ohtsu et al. | 227/10 |

*Primary Examiner*—Paul A. Bell

*Attorney, Agent, or Firm*—Lowe, Price, LeBlanc, Becker & Shur

[57] ABSTRACT

In an internal-combustion piston driving apparatus comprising a housing, a cylinder cover fixed to the housing, a cylinder slidably provided to the housing, a piston reciprocally slidably provided in the cylinder, a combustion chamber defined by the housing, the cylinder, and the piston, a fuel supplying device for supplying fuel to the combustion chamber, and an ignition control device for producing a high voltage to ignite the fuel supplied to the combustion chamber, piston position detector for detecting a position of the piston is provided at the wall of the cylinder between top dead point and bottom dead point of the piston. Besides, a decompression channel is provided so as to connect the combustion chamber placed upper than the top dead point with atmosphere for exhausting a combusted gas in the combustion chamber when the piston passes the piston position detector. The decompression channel is opened and closed by means of slide of the cylinder. In addition, a suction valve is provided to the cylinder cover to be placed lower than bottom dead point of the piston whereby the piston is returned by means of atmospheric pressure after a power stroke of said piston.

8 Claims, 6 Drawing Sheets

INTERNAL-COMBUSTION PISTON DRIVING APPARATUS HAVING A DECOMPRESSION CHANNEL

BACKGROUND OF THE INVENTION

1. Field of the Invention

This invention relates generally to an apparatus for driving a piston, and particularly to a piston driving apparatus, such as an engine-powered nailer, utilizing the fuel combustion energy.

2. Prior Art

One example of a conventional piston driving apparatus is disclosed in U.S. Pat. No. 4403722 as a combustion gas-powered fastener driving tool. In an embodiment of the disclosed tool, a piston is reciprocally moved up and down in a cylinder by a pressure originated by the combustion of fuel gas, and a combusted gas is exhausted from a port which is provided between the top dead point and the bottom dead point after the piston passes the port in a compression stroke. The combustion of the gas advances from an ignition plug to the upper surface of the piston. In this structure, however, since an unburned gas following the piston movement is firstly exhausted at the upper surface of the piston from the port, the fuel consumption rate is high. In addition, such an exhausted unburned gas is in danger of explosion when this tool is used at a badly ventilated place.

SUMMARY OF THE INVENTION

The present invention has been developed in order to remove the above-described drawbacks inherent to the conventional piston driving apparatus.

It is, therefore, an object of the present invention to provide a new and useful internal-combustion piston driving apparatus having lower fuel consumption rate.

It is another object of the invention to provide an internal-combustion piston driving apparatus which is safe from explosion.

In accordance with the present invention there is provided an internal-combustion piston driving apparatus comprising: a housing having an opening at one end thereof; a cylinder cover fixed to the housing; a cylinder recieved in the housing, the cylinder being slidable relative to the housing between first and second positions; a piston reciprocally slidably recieved in the cylinder, a combustion chamber being defined by the housing, the cylinder, and the piston; means for supplying fuel to the combustion chamber; an ignition device for igniting the fuel supplied into the combustion chamber; cylinder moving means for moving the cylinder from the first position to the second position when the piston moved toward bottom dead point beyond a predetermined point; and a decompression channel for establishing communication between the combustion chamber and atmosphere at a place above top dead point of the piston when the cylinder is in the second position, the decompression channel being closed when the cylinder is in the first position.

In accordance with the present invention there is also provided an internal-combustion piston driving apparatus comprising: a housing having an opening at one end thereof; a cylinder cover fixed to the housing; a cylinder fixed to the housing; a piston reciprocally slidably received in the cylinder, a combustion chamber being defined by the housing, the cylinder, and the piston; means for supplying fuel to the combustion chamber; an ignition device for igniting the fuel supplied into the combustion chamber; valve means for moving a valve between first and second position, the valve means being provided around the combustion chamber; and a decompression channel for establishing communication between the combustion chamber and atmosphere at a place above top dead point of the piston when the valve is in the second position, the decompression channel being closed when the valve is in the first position.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 1:
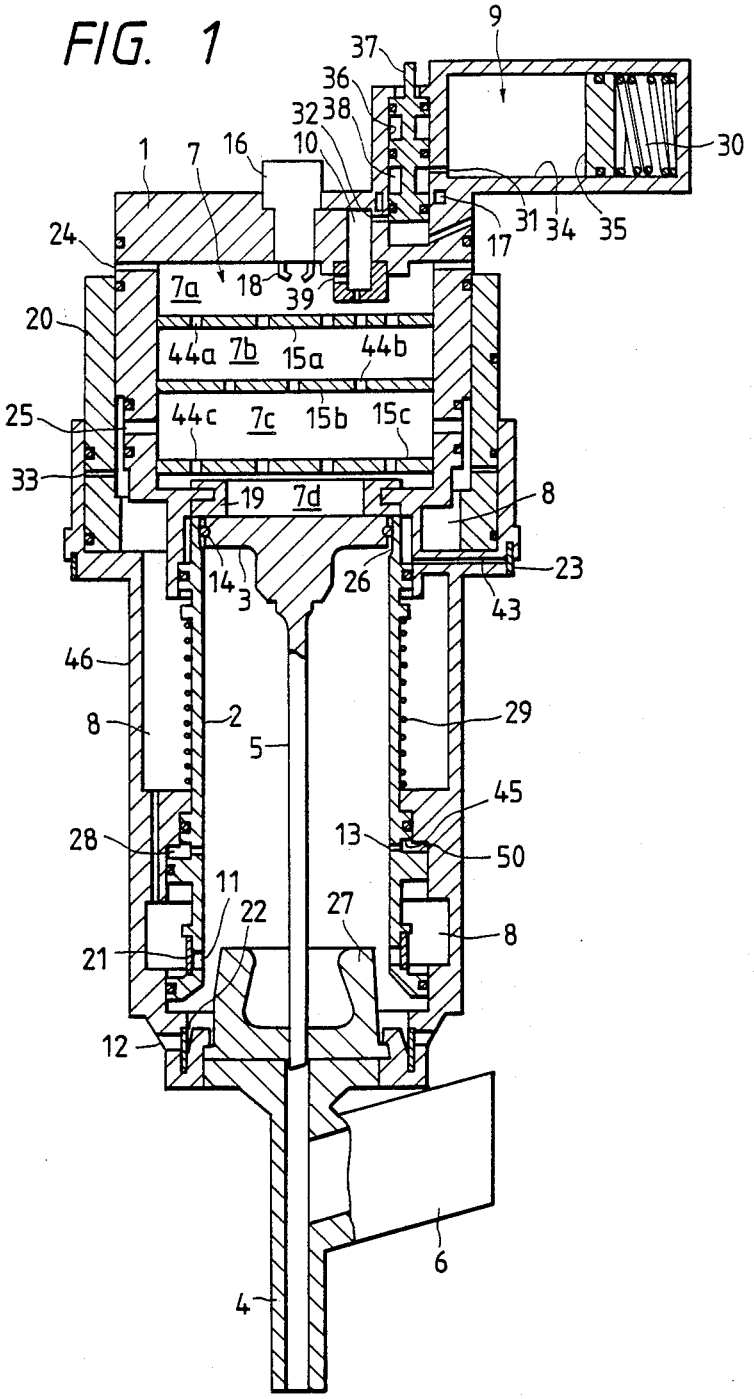
FIG. 1 is a longitudinal sectional view of a fastener driving device including a first embodiment internal-combustion piston driving device according to the present invention, and which shows a state before a fastener is driven.

A first embodiment of an internal-combustion piston driving apparatus applied to a fastener driving device will be described with reference to FIG. 1 first.

The fastener driving device generally comprises a cylindrical housing 1 having an opening at one end thereof, a cylinder cover 46 which is fixed at the opening side of the housing 1 as one body, a cylinder 2 which is received in a space defined by the cylinder cover 46 and the housing 1, a piston 3 which is reciprocally slidably received in the cylinder 2, a rod guide 4 which is fixed to the cylinder cover 46. The cylinder 2 is slidable relative to the housing. A percussion rod 5 is fixed to the piston 3, and is moved so as to pass through the rod guide 4 for driving fasteners (not shown) which are successively fed from a fastener magazine 6. A combustion chamber 7 is defined by the piston 3, the cylinder 2, and the housing 1, and an O-ring 14 is provided to the contacting portion of the piston 3 with the cylinder 2 for keeping airtightness of the combustion chamber 7. The combustion chamber 7 is divided into four chambers 7*a*, 7*b*, 7*c*, and 7*d* by means of three plates or partitions 15*a*, 15*b*, and 15*c* respectively having a number of through-holes 44*a*, 44*b*, and 44*c*. An exhaust port 24 is provided to the housing 1 near its closed end, and a scavenging port 25 is provided to the housing 1 near its open end. Therefore, the chamber 7*a* is communicated with the outside of housing 1 via the exhaust port 24, and the chamber 7*c* is communicated with the outside of the same via the scavenging port 25. An ignition control device 16 is attached to the closed end of the housing 1 for generating high voltage by using a piezoelectric device (not shown), and an ignition plug 18 is mounted to the ignition control device 16 such that the tip end of the ignition plug 18 is placed within the combustion chamber 7.

Figure 2:
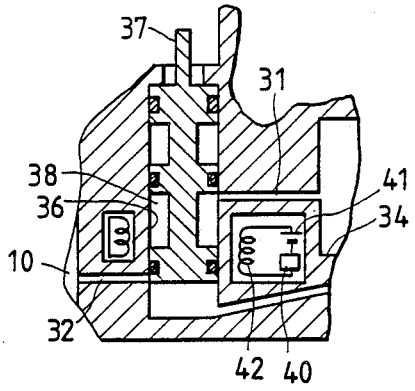
FIG. 2 is a partially enlarged longitudinal sectional view of a measuring chamber portion of the first embodiment showing a state that a slidable measuring valve is at the top dead point.
Figure 3:
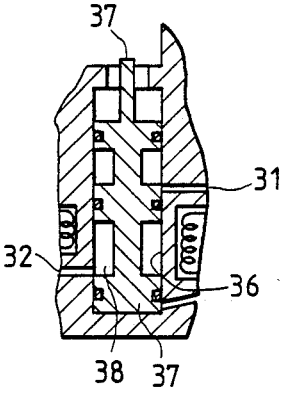
FIG. 3 is a partially enlarged longitudinal sectional view of a measuring chamber portion of the first embodiment showing a state that a slidable measuring valve is at the bottom dead point.

The housing 1 has a fuel supplying device to supply fuel to the combustion chamber 7. The fuel supplying device generally includes a fuel cylinder 34, a measuring cylinder 36, a carburetion chamber 10, and a nozzle 39. A fuel piston 35 is reciprocally movable in the fuel cylinder 34 and a fuel chamber 9 is defined by the fuel cylinder 34 and the fuel piston 35. For example, the fuel chamber 9 is filled with a liquified combustible fuel, such as butane, which is compressed by means of a spring 30 fixed to the fuel piston 35. Meanwhile, a measuring valve 37 is slidably provided in the measuring cylinder 36. The detailed structure of the measuring cylinder 36 and the measuring valve 37 is shown in FIGS. 2 and 3. The measuring cylinder 36 and the measuring valve 37 define a measuring chamber 38, and a temperature control device 17 is embeded in the measuring cylinder 36 so as to surround the measuring chamber 38.

The temperature control device 17 includes a battery 41, a heater 42 provided around the measuring chamber 38, and a thermosensitive element 40. In this structure, the heater 42 is energized by means of the battery 41 thereby increasing the temperature of the liquified fuel in the measuring chamber 38. When such fuel temperature is raised, the resistance of the thermosensitive element 40 increases. Therefore, the calorific value of the heater 42 decreases. Meanwhile, when the fuel temperature falls, the resistance of the thermosensitive element 40 decreases thereby increasing the calorific value of the heater 42. Thus, the fuel temperature is controlled.

The nozzle 39 is provided to the housing 1 so as to be position in the combustion chamber 7, the nozzle 39 and the housing define the carburetion chamber 10. The measuring chamber 38 is communicated, via a first channel 31, with the fuel chamber 9, and is communicated, via a second channel 32, with the carburetion chamber 10. The positioning condition of the first and second channels 31 and 32 is as follows. When the measuring valve 37 is at the top dead point as shown in FIG. 2, the first channel 31 is opened, and the second channel 32 is closed by the measuring valve 37. When the measuring valve 37 is at the bottom dead point as shown in FIG. 3, the first channel 31 is closed, and the second channel 32 is opened.

Figure 4:
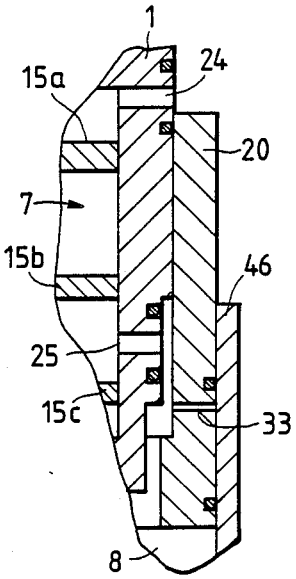
FIG. 4 is a partially enlarged longitudinal sectional view of inventilation sleeve portion of the first embodiment showing a state that a ventilation sleeve is at a lower position.
Figure 5:
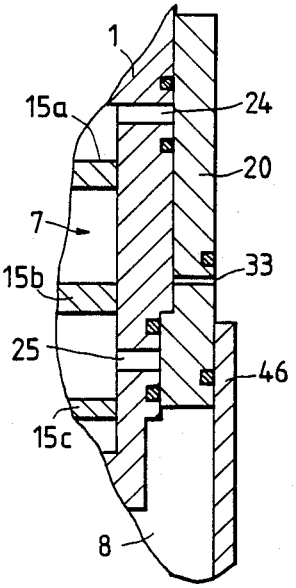
FIG. 5 is a partially enlarged longitudinal sectional view of a ventilation sleeve portion of the first embodiment showing a state that a ventilation sleeve is at an upper position.
Figure 6:
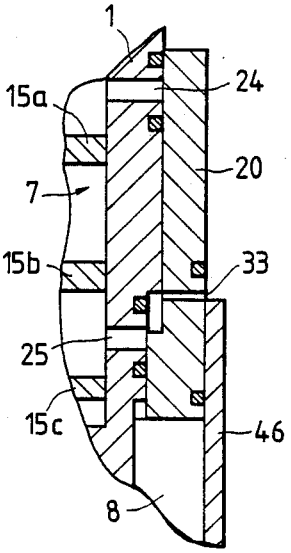
FIG. 6 is a partially enlarged longitudinal sectional view of a ventilation sleeve portion of the first embodiment showing a state that a ventilation sleeve is at a middle position.

A ventilation sleeve 20 is slidably provided between the upper portion of the cylinder cover 46 and the side wall of the housing 1. The measuring valve 37 and the ventilation sleeve 20 are mechanically connected to a projection (not shown) slidably provided at the tip end of the rod guide 4 by conventional connecting means (not shown). In other words, when the projection is pushed due to a fastener driving with the tip end of the rod guide 4 being contacted with a work piece in which the fastener is to be driven, the measuring valve 37 is in the top dead point, and the sleeve 20 is in the upper position. In addition, a spring (not shown) is provided to the projection so that the sleeve 20 and the valve 37 are returned to an original position. Thus, the exhaust port 24 and the scavenging port 25 are opened and closed by the slidable ventilation sleeve 20. FIGS. 4 to 6 show the operations of the ventilation sleeve 20. FIG. 4 illustrates a state of the ventilation sleeve 20 before a fastener is driven, and FIG. 5 shows a state of the ventilation sleeve 20 on fuel combustion. FIG. 6 illustrates a state of the ventilation sleeve 20 after the return stroke of the piston 3 finishes. The ventilation sleeve 20 has a third channel 33 as a scavenging channel, and the ventilation sleeve 20, the cylinder 2, the cylinder cover 46, and the housing 1 define a pressure accumulating chamber 8. When the ventilation sleeve 20 is at the lower position as shown in FIG. 4, the pressure accumulating chamber 8 is communicated with the combustion chamber 7 via the scavenging port 25. When the ventilation sleeve 20 is at the upper position as shown in FIG. 5, the airtightness of the pressure accumulating chamber 8 is kept thereby. When the ventilation sleeve 20 is at the middle position as shown in FIG. 6, the combustion chamber 7 is opened, via the scavenging port 25 and the third channel 33, to the atmosphere.

The cylinder 2 has a piston stop portion 26 whose inner diameter is larger than another inner diameter of the cylinder 2, and the piston stop portion 26 is formed at the upper end of the cylinder 2, i.e. at the side in which the plates 15*a*, 15*b*, and 15*c* are provided. When the piston 3 is positioned at the piston stop portion 26, the piston is supported at the piston stop portion 26 by the elasticity of the O-ring 14. A cylinder damper 19 is provided at the opening side of the housing 1 for preventing a further upward movement of the cylinder 2 and the piston 3, and a piston damper 27 is fixed at the lower portion of the cylinder cover 46 to which the rod guide 4 is provided. Therefore the reciprocal movement distance of the piston 3 is determined by the position of the cylinder damper 19 and the piston damper 27.

Furthermore, the cylinder 2 has a fourth channel 11 for communicating the lower inner space of the cylinder 2 with the pressure accumulating chamber 8, and the fourth channel 11 is positioned at the portion lower than the bottom dead point of the piston 3. A pressure accumulating valve 21 is provided at the cylinder 2 to open and close the fourth channel 11, whereby only a stream flowing into the pressure accumulating chamber 8 from the lower inner space of the cylinder 2 is allowed to pass through the fourth channel 11.

Moreover, the cylinder 2 has an upper pressure-receiving portion 45, and a lower pressure-receiving portion 50 at the outer surface thereof as shown in FIG. 1. The upper pressure-receiving portion 45, the lower pressure receiving portion 50, and the cylinder cover 46 define a pressure sensing chamber 28, and a fifth channel or a pressure sensing channel 13 is provided such that the pressure sensing chamber 28 is communicated with the inner space of the cylinder 2. The fifth channel 13 and the pressure sensing chamber 28 operate as a piston position detecting device for detecting the position of the piston 3. The area of the lower pressure-receiving portion 50 is larger than the same of the upper pressure-receiving portion 45.

The cylinder cover 46 has a suction port 12 which is formed at a portion lower than the bottom dead point thereof and a suction valve 22 at the inner lower portion thereof to suck an outside air via the suction port 12. A reference numeral 43 denotes a decompression channel connecting the combustion chamber 7 with the atmosphere at a place above top dead point of the piston for establishing communication therebetween, and a decompression valve 23 is so provided to allow only a stream from the combustion chamber 7 to the atmosphere. It is to be noted that the decompression channel 43 is communicated with the combustion chamber wall upper than the top dead point to exhaust a combusted gas from the upper portion than the top dead point. Around the outer periphery of the cylinder 2, a cylinder spring 29 is provided between the cylinder 2 and the cylinder cover 46 so as to urge the cylinder 2 toward the three plates 15*a*, 15*b*, and 15*c*. The decompression channel 43 is also opened and closed by means of the cylinder damper 19 and the cylinder 2, and a scavenging means is formed of these members, i.e. the decompression channel 43, the decompression valve 23, the cylinder 2, and the cylinder damper 19.

Now, the operation of the above-mentioned fastener driving device will be described hereinbelow. Turning to FIG. 1, the piston 3 is positioned at the piston stop portion 26. FIG. 1 shows a state just before the fastener driving device is worked. Since the ventilation sleeve 20 is at the lower position, the exhaust port 24 and the scavenging port 25 are opened. The decompression port 43 is closed by the cylinder damper 19 and the cylinder 2. Since the measuring valve 37 is positioned at the uppermost portion as shown in FIG. 2, the liquified fuel in the fuel chamber 9 flows into the measuring chamber 38 via the first channel 31. The fuel flowed into the measuring chamber 38 is heated by the temperature control device 17.

First, the ventilation valve 20 is moved to the upper position to close the exhaust port 24 and the scavenging port 25 of the combustion chamber 7 as shown in FIG. 5, and then the measuring valve 37 is moved to the lower position as shown in FIG. 3 to send the fuel in the measuring chamber 38 into the carburetion chamber 10. Vaporized fuel is discharged, via the nozzle 39, to the combustion chamber 7. Therefore, the combustion chamber 7 is filled with a combustible mixture of the fuel gas and air. After this, the combustible mixture is fired by the spark from the ignition plug 18 with the ignition control device 16 being operated. Then, the combusted gas in the chamber 7*a* expands, and subsequently flows into the chambers 7*b*, 7*c*, and 7*d* via the through-holes 44*a*, 44*b*, and 44*c* of the respective plates 15*a*, 15*b*, and 15*c*.

It is to be noted that, at this time, if an unburned gas remains in the combustion chamber 7, the expanding combustion gas pushes the remaining unburned gas, i.e. a remaining unburned gas in the chamber 7*a* subsequently flows into the chambers 7*b*, 7*c*, and 7*d* by the combustion in the chamber 7*a*. Here, in the chamber 7*b*, turbulent flows are caused by such unburned gas passed through the through-holes 44*a*, because the plate 15*a* operates as an obstacle for the stream of the gas flowing into the chamber 7*b* from the chamber 7*a* thereby generating vortices just under the through-holes 44*a* of the plate 15*a*. Similarly, such vortices are also caused in the chambers 7*c* and 7*d* by the plates 15*b* and 15*c*.

Figure 7:
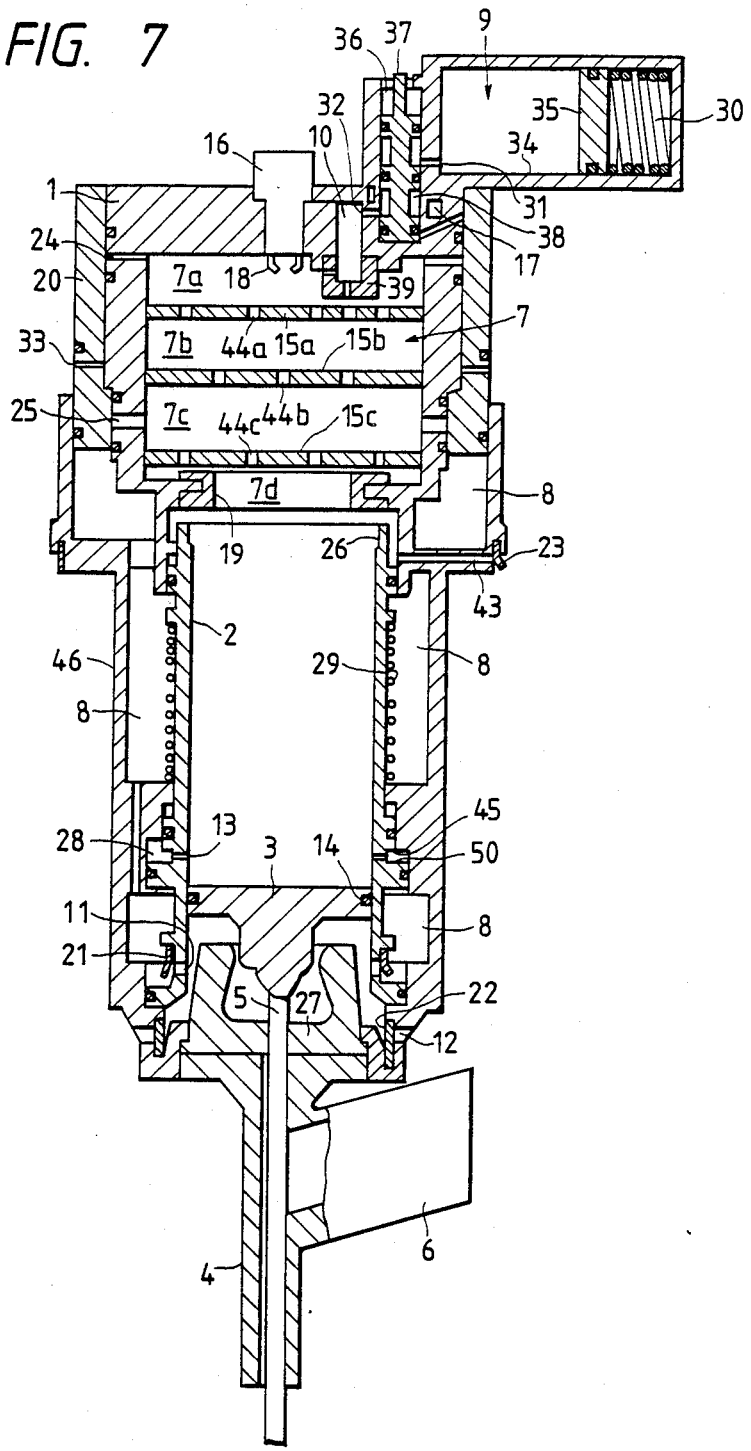
FIG. 7 is a longitudinal sectional view of the internal-combustion piston driving apparatus showing a state just after the fastener has been driven.

Since the flame in the chamber 7*a* is a laminar premix combustion, the combustion speed is low. However, after the flame passes through the through-holes 44*a* of the plate 15*a*, since the flame in the chamber 7*b* is a turbulent premix combustion due to the vortices, the combustion speed is high. Thus the combustion speed increases. Then, the flowing speed of the combusted gas flowing into the chamber 7*c* from the chamber 7*b* increases by the increase of the combustion speed, and the vortices occurring under the plate 15*b* becomes stronger, thereby causing a strong turbulent flow. When the flame is propagated into the chamber 7*c* by the strong turbulent flow, the combustion speed further increases. Thus, the increasing rate of the combustion speed becomes higher in every passing through the subsequent plates 15*a*, 15*b*, and 15*c* so that the pressure of the combustion chamber 7 becomes high in an instant. By this high pressure, the piston 3 which is held at the piston stop portion 26 by the O-ring 14 is moved toward the rod guide 4 as shown in FIG. 7 thereby starting a power stroke. Then the fastener is driven into a work piece.

Meanwhile, since air under the piston 3 is compressed by the combustion, this air flows, via the pressure accumulating valve 21, into the pressure accumulating chamber 8. At this time, the suction port 12 is closed by the suction valve 22, and the decompression channel 43 is closed by the cylinder 2 and the cylinder damper 19 so that the gas in the combustion chamber 7 cannot flow to outside thereof.

In the power stroke, after the piston 3 passes the fifth channel 13, i.e. when the piston 3 moved toward bottom dead point beyond the fifth channel 13, the high pressure gas in the combustion chamber 7 flows into the pressure sensing chamber 28. Then, since the area of the lower pressure-receiving portion 50 is larger than that of the upper pressure-receiving portion 45, the cylinder 2 is moved toward the bottom dead point by the pressure difference between the lower and the upper pressure-receiving portions 45 and 50, because the force applied to the lower pressure-receiving portion 50 is larger than the force of restitution of the cylinder spring 29. Therefore, the decompression channel 43 opens, and the high pressure combusted gas flows, via the decompression valve 23, to the outside, i.e. to the atmosphere. Here, the combustion of the fuel gas is propagated from the ignition plug 18 to the top dead point of the piston 3. In this power stroke, the fuel gas near the upper surface of the piston 3 is finally combusted. Thus, the scavenging means is operated with the piston position detecting means being operated.

It is to be noted that since the gas near the decompression channel 43 is completely combusted at this time, no unberned gas is mixed with the gas to be exhausted from the decompression valve 23. After the combusted gas is exhausted, the pressure of the combustion chamber 7 decreases so that the decompression channel 43 can be closed by the decompression valve 23. Then the piston 3 collides against the piston damper 27, and therefore, the power stroke is finished. Thus, the piston damper 27 is operated for damping the collision shock of the piston 3.

In other words, after such a burning reaction is completely finished, the rapid increase of the temperature and pressure in the combustion chamber 7 is stopped. After the combusted gas is exhausted, the pressure in the combustion chamber 7 becomes equal to the atmospheric pressure. Therefore, the combustion chamber 7 is closed with the decompression channel 43 being closed. Meanwhile, since the pressure in the pressure sensing chamber 28 is also decreased, the cylinder 2 is returned to the original position by the restitution force of the cylinder spring 29 thereby contacting with the cylinder damper 19. At this time, however, since the temperature of remaining combusted gas is so high yet, the remaining gas is in an expanded state.

In a return stroke after the piston 3 collides against the piston damper 27, the inside temperature of the cylinder 2 are rapidly decreased so that the deflation of the remaining gas in the combustion chamber 7 occurs. As a result, the pressure in the combustion chamber 7 becomes lower than the atmospheric pressure. Thus, since the combustion chamber 7 is closed and the temperature of the remaining gas is rapidly decreased, the pressure of an upper chamber portion placed above the piston 3 is rapidly decreased by the rapid deflation of the remaining combusted gas. Therefore, the atmospheric air is flowed into a lower chamber portion placed under the piston 3 with the suction valve 22 being opened. Accordingly, the piston 3 slides toward the three plates 15*a*, 15*b*, and 15*c* by the pressure difference between the upper chamber portion and the lower chamber portion at this time. Then this movement of the piston 3 is limited by the cylinder damper 19. As the result, the piston 3 is returned to the piston stopper position 26 by the elasticity of the O-ring 14. In this operation, the pressure accumulating chamber 8 is sealed by the pressure accumulating valve 21 whereby the accumulated air in the pressure accumulating chamber 8 can be kept. According to an experiment of such a return stroke of the piston 3, the pressure difference between the upper portion and the lower portion of the piston 3 is approximately 0.2 atm., and piston returning time from the bottom dead point to the top dead point is approximately 0.3 sec.

Subsequently, since the projection at the tip end of the rod guide 4 is separated from the work piece, the ventilation sleeve 20 is returned to the original position. At this time, the ventilation sleeve 20 is set to the middle position as shown in FIG. 6 in a moment so that the exhaust port 24 is closed and that the combustion chamber 7 is momentarily communicated, via the scavenging port 25 and the third channel 33, with the atmosphere. Then, the atmospheric air flows into the combustion chamber 7 because the inside pressure of the combustion chamber 7 is smaller than the atmospheric pressure. The concentration of the combusted gas in the combustion chamber 7 is low at the portion near the scavenging port 25, and is high at the portion near the exhaust port 24.

Then, the ventilation sleeve 20 is returned to the lower position as shown in FIG. 4 so that the exhaust port 24 and the scavenging port 25 are opened and that a pressurized air in the pressure accumulating chamber 8 is sent, via the scavenging port 25, to the combustion chamber 7. Therefore, the remaining air in the combustion chamber 7 is pushed by the pressurized air to be exhausted from the exhaust port 24.

As will be understood from the above description, the combusted gas remaining in the combustion chamber 7 is exchanged with the pressurized air, and the ventilation is finished. Thus, the combusted gas can be efficiently exhausted by the accumulated air, whereby the condition of the fastener driving device is returned to that of FIG. 1.

Figure 8:
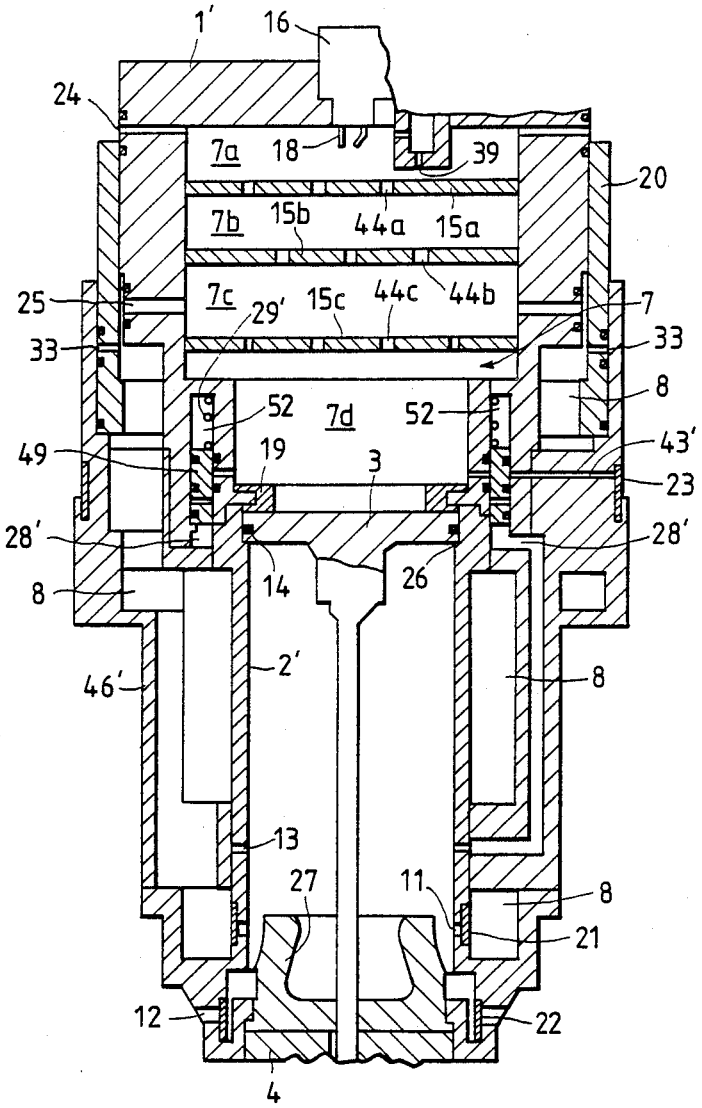
FIG. 8 is a partially enlarged longitudinal sectional view of a fastener driving device including a second embodiment internal-combustion piston driving apparatus according to the present invention, and which shows a state that a decompression channel is closed.

In the first embodiment, although the cylinder 2 provided in the housing 1 is slided for opening or closing the decompression valve 43, the cylinder 2 may be fixed to the housing 1 as the following description of a second embodiment. A second embodiment of the fastener driving device to which the internal-combustion piston driving apparatus of the present invention is applied will be described with reference to FIGS. 8 and 9. FIG. 8 shows a state before the fastener driving device is operated, and the fastener driving device according to the second embodiment is different from the same of the first embodiment in that cylinder 2' is fixed to housing 1', and that a control chamber 52 provided in the housing 1' so as to be positioned between the inlet and outlet of decompression channel 43'. Owing to this, sensing chamber 28' is provided between the fifth channel 13 and the control chamber 52 to transmit an inside pressure of the cylinder 2', and is defined by the housing 1', the cylinder 2', the control valve 49, and the cylinder cover 46'. In other words, the sensing chamber 28' is directly communicated with the control chamber 52, and is communicated, via the fifth channel 13, with the inside of the cylinder 2'. A control valve 49 is slidably provided in the control chamber 52 for opening and closing the decompression channel 43', and is urged by a spring 29' toward the lower portion in the illustration.

Figure 9:
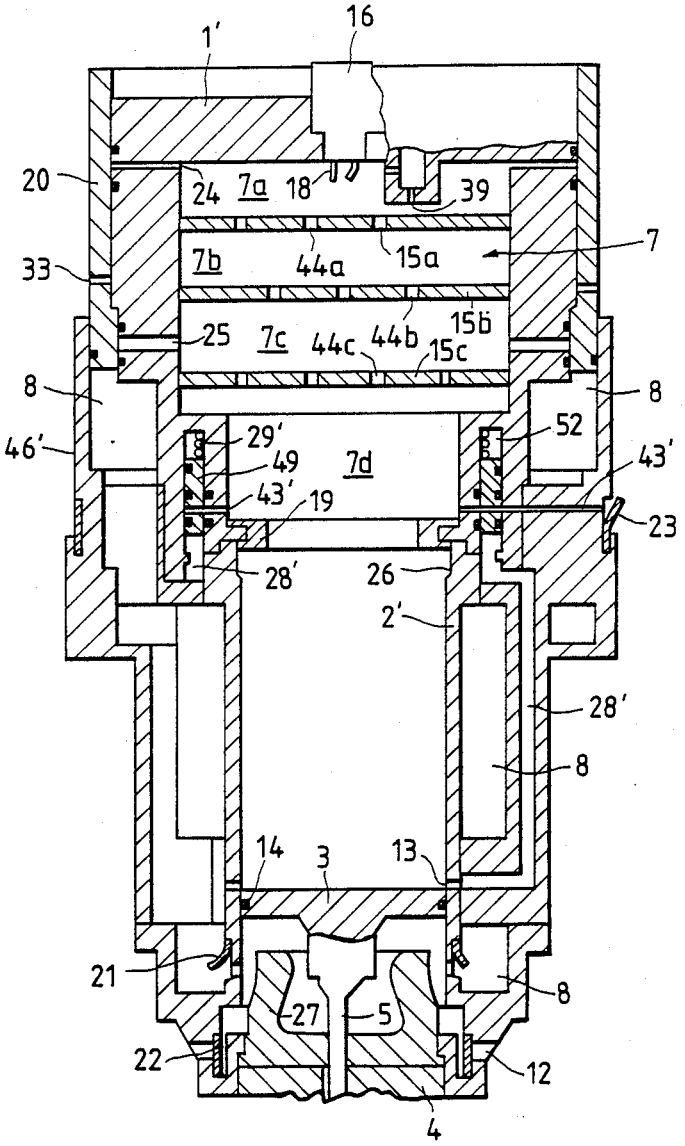
FIG. 9 is a partially enlarged longitudinal sectional view of the fastener driving device of FIG. 8, and which shows a state that the decompression channel is opened by a control valve in a power stroke.

The operation of the control valve 49 will be described. In a state before the fastener driving device is operated, the control valve 49 is at the lower position. Therefore, the decompression channel 43' is closed as shown in FIG. 8. In a power stroke of the piston 3, when the piston 3 passes the fifth channel 13, the pressure of the pressure sensing chamber 28' increases so that the control valve 49 is moved upward against the urged force of the control spring 29' as shown in FIG. 9. Therefore, the decompression channel 43' is opened to exhaust a combusted gas from the combustion chamber 7. In this embodiment, the operation of the control valve 49 for opening and closing the decompression channel 43' is achieved by means of such a miniaturized control valve structure. Accordingly, the open/close operation time period of the control valve 49 is shorter than that of the cylinder 2 according to the first embodiment.

Figure 10:
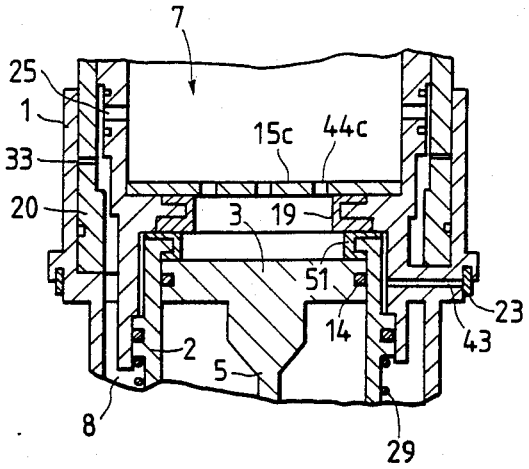
FIG. 10 is a partially enlarged longitudinal sectional view of a fastener driving device including a third embodiment internal-combustion piston driving apparatus of the present invention, and which shows a state that a decompression channel is closed.
Figure 11:
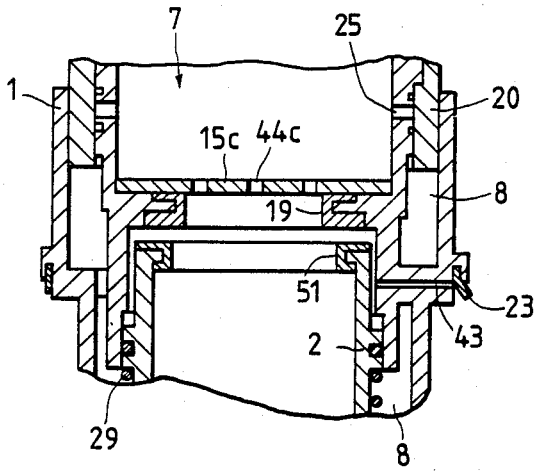
FIG. 11 is a partially enlarged longitudinal sectional view of the fastener driving device of FIG. 10, and which shows a state that the decompression channel is opened.

FIG. 10 is a partially enlarged longitudinal sectional view of a fastener driving device including a third embodiment internal-combustion piston driving apparatus of the present invention, and which shows a state that the decompression channel 43 is closed before the fastener driving device is operated. This fastener driving device is similar to the same of FIG. 1 except that an auxiliary damper 51 is provided to the upper end portion of the cylinder 2. FIG. 11 is a partially enlarged longitudinal sectional view of the fastener driving device of FIG. 10, and which shows a state that the decompression channel 43 is opened in a power stroke. This fastener driving device is similar to the same of FIG. 7 except that the auxiliary damper 51 is provided to the upper end portion of the cylinder 2.

In FIG. 10, the decompression channel 43 is closed by the cylinder damper 19 and the auxiliary damper 51. Then, after the piston 3 passes the fifth channel 13 in the power stroke thereof, the decompression channel 43 is opened with the cylinder 2 being descented as shown in FIG. 11 in the same manner as the above-mentioned operation of the first embodiment. Owing to the auxiliary damper 51, a shock in the closing operation of the cylinder 2 can be attenuated.

As will be understood from the above description, in the present invention, since the decompression channel 43 or 43' for exhausting the combusted gas to the outside is communicated with the inside wall provided at the upper portion than the top dead point, the unburned gas following the moving piston cannot be exhausted in the power stroke of the piston 3. Therefore, danger of explosion due to the exhausted unburned gas is avoidable even when this tool is used at a badly ventilated place. In addition, since the unburned gas following the piston 3 is combusted in the power stroke, fuel consumption rate can be improved. Besides, although the combustion chamber 7 is divided into the four chambers *7a, 7b, 7c,* and *7d* in these embodiments, if the chamber 7 is divided into at least two chambers by means of at least one plate having a number of through-holes therein, similar effects to these embodiments can be achieved thereby.

The above-described embodiments are just examples of the present invention, and therefore, it will be apparent for those skilled in the art that many modifications and variations may be made without departing from the scope of the present invention.

What is claimed is:

1. An internal-combustion piston driving apparatus comprising:

(a) a housing having an opening at one end thereof;
(b) a cylinder cover fixed to said housing;
(c) a cylinder fixed to said housing;
(d) a piston reciprocally slidably received in said cylinder, a combustion chamber being defined by said housing, said cylinder, and said piston;
(e) means for supplying fuel to said combustion chamber;
(f) an ignition device for igniting said fuel supplied into said combustion chamber;
(g) valve means for moving a valve between first and second position, said valve means being provided around said combustion chamber; and
(h) a decompression channel for establishing communication between said combustion chamber and atmosphere at a place above top dead point of said piston when said valve is in said second position, said decompression channel being closed when said valve is in said first position.

2. An internal-combustion piston driving apparatus as claimed in claim 1, wherein said combustion chamber is divided into at least two chambers by means of at least one plate having a number of through-holes therein.

3. An internal-combustion piston driving apparatus as claimed in claim 1, further comprising suction valve means provided to said cylinder cover to be placed below bottom dead point of said piston whereby said piston is returned by means of atmospheric pressure after a power stroke of said piston.

4. An internal-combustion piston driving apparatus comprising:

(a) a housing having an opening at one end thereof;
(b) a cylinder cover fixed to said housing;
(c) a cylinder recieved in said housing, said cylinder being slidable relative to said housing between first and second positions;
(d) a piston reciprocally slidably recieved in said cylinder, a combustion chamber being defined by said housing, said cylinder, and said piston;
(e) means for supplying fuel to said combustion chamber;
(f) an ignition device for igniting said fuel supplied into said combustion chamber;
(g) cylinder moving means for moving said cylinder from said first position to said second position when said piston moved toward bottom dead point beyond a predetermined point; and
(h) a decompression channel for establishing communication between said combustion chamber and atmosphere at a place above top dead point of said piston when said cylinder is in said second position, said decompression channel being closed when said cylinder is in said first position.

5. An internal-combustion piston driving apparatus as claimed in claim 4, wherein said cylinder moving means includes:

(a) a pressure sensing chamber defined by said cylinder cover and an upper pressure-receiving portion and a lower pressure-receiving portion which are provided at outside surface of said cylinder, area of said lower pressure-receiving portion being larger than that of said upper pressure-receiving portion; and
(b) a pressure sensing channel connecting said pressure sensing chamber with inside of said cylinder.

6. An internal-combustion piston driving apparatus as claimed in claim 4, wherein said combustion chamber is divided into at least two chambers by means of at least one plate having a number of through-holes therein.

7. An internal-combustion piston driving apparatus as claimed in claim 4, further comprising damper means provided at the tip end portion of said cylinder for attenuating a shock in a closing operation of said cylinder.

8. An internal-combustion piston driving apparatus as claimed in claim 4, further comprising suction valve means provided to said cylinder cover to be placed below bottom dead point of said piston whereby said piston is returned by means of atmospheric pressure after a power stroke of said piston.

* * * * *